US007817000B2

(12) United States Patent
Rauh

(10) Patent No.: US 7,817,000 B2
(45) Date of Patent: Oct. 19, 2010

(54) SELECTIVELY CONFIGURABLE RELAY

(75) Inventor: Georg Rauh, Zirndorf (DE)

(73) Assignee: Siemens Aktiengesellschaft, Munich (DE)

( * ) Notice: Subject to any disclaimer, the term of this patent is extended or adjusted under 35 U.S.C. 154(b) by 204 days.

(21) Appl. No.: 11/938,827

(22) Filed: Nov. 13, 2007

(65) Prior Publication Data

US 2008/0110740 A1 May 15, 2008

(30) Foreign Application Priority Data

Nov. 13, 2006 (DE) ..... 10 2006 053 423

(51) Int. Cl.
*H01H 51/22* (2006.01)

(52) U.S. Cl. ..... 335/78; 200/280

(58) Field of Classification Search ..... 335/78, 335/128, 220–229; 200/280, 281, 526, 527
See application file for complete search history.

(56) References Cited

U.S. PATENT DOCUMENTS 5,001,316 A * 3/1991 Salaman ..... 200/527
5,049,709 A * 9/1991 Prickett et al. ..... 200/527
5,894,255 A * 4/1999 Wallintin ..... 335/80
6,081,176 A 6/2000 Dittmann et al.
6,204,740 B1 3/2001 Nakahata
6,606,018 B2 * 8/2003 Takano et al. ..... 335/78
6,650,210 B1 * 11/2003 Raklyar et al. ..... 335/4
6,710,689 B2 * 3/2004 Wohlfarth ..... 335/78
7,551,048 B2 * 6/2009 Iwata et al. ..... 335/78

FOREIGN PATENT DOCUMENTS

DE 27 33 800 A1 2/1979
DE 199 19 425 C2 5/2000
DE 199 13 903 C1 1/2001

* cited by examiner

*Primary Examiner*—Elvin G Enad
*Assistant Examiner*—Bernard Rojas
(74) *Attorney, Agent, or Firm*—Schiff Hardin LLP

(57) ABSTRACT

A relay, in particular for radio-frequency applications, has at least one first contact electrically connected with a first conductor trace, the first contact in a contact position can be selectively electrically connected by a mechanical actuator with at least two second contacts electrically connected with at least one second conductor trace. The relay has a spatially fixed first circuit board with the first contact and the first conductor trace and a second circuit board with the second contacts and the second conductor trace that can be moved against the first circuit board into various contact positions by the mechanical actuator.

25 Claims, 9 Drawing Sheets

SELECTIVELY CONFIGURABLE RELAY

BACKGROUND OF THE INVENTION

1. Field of the Invention

The present invention concerns a relay, in particular for radio-frequency applications, of the type having at least one first contact electrically connected with at least one first conductor trace printed conductor, the first contact, in a contact position, being selectively connectable by a mechanical actuator with at least two second contacts that are electrically connected with at least one second conductor trace.

2. Description of the Prior Art

Relays are frequently used in radio-frequency engineering (in particular in power applications) as robust and technically less complicated components. As a single-unit solution for specific functionalities, relays are available in various forms that for the most part perform quite simple switching functions.

If the switching functions are more complex, however, (for example in radio-frequency power engineering), it is frequently necessary to use various available relays that must be interconnected and mounted in a more complicated manner so that the desired switching function can be realized. This is also costly since the special solutions require many components. Solutions with relays therefore frequently prove to be disadvantageous.

In order to avoid having to connect a number of relays into an assembly group in a complicated manner, individual solutions for special cases have also been proposed and developed in which the relay switching functions and the mechanism are integrated into a circuit board. The mechanism and the switching function are thereby very closely interlocked with one another and thus the relay can be used for only the special case for which it was developed.

SUMMARY OF THE INVENTION

An object of the present invention is to provide a relay with which various switching functions can be realized in a simple manner using a uniform mechanical design.

This object is achieved in a relay of the aforementioned type wherein, in accordance with the invention, the relay has a spatially fixed first circuit board with the first contact and the first conductor trace; and a second circuit board with the second contacts and the second conductor trace, the second circuit board being selectively moved relative to the first circuit board into any of various contact positions by the mechanical actuator.

Accordingly, in the inventive relay two circuit boards are provided that ultimately define the switching function themselves. Depending on how the contacts and the conductor traces are fashioned on the circuit boards, it is possible to realize a wide variety of switching functions by only variation of the configuration of the circuit boards. A first, stationary circuit board is provided that can have the connection conductors integrated into a larger circuit, as well as the first contacts. The second (normally smaller) movable circuit board can be arranged parallel to the first circuit board, and the second contacts and the second conductor traces are designed such that the corresponding switching functions can be executed.

The design of the mechanical mobility of the second circuit board that is realized by the mechanical actuator is entirely separate from the actual electrical function. It must merely cause the second circuit board to be moved into the various contact positions by the mechanical actuator. Arbitrary electrical functions or switching functions thus can be realized largely independently of the embodiment of the mechanism. The mechanical actuator can be produced separately from the circuit boards. The second circuit board can then be bolted, riveted or glued the actuator.

The interface between the electronics and the mechanism (thus the coupling of the first and second circuit boards to the mechanical actuator) can be standardized with particular advantage. Significant savings in costs are thereby enabled since the mechanical actuator can be used for a number of relays.

It is also possible to design the relay such that the first and/or the second circuit boards is/are mounted such that they can be removed and exchanged for a different circuit board. It is then possible to adapt or to modify the switching function of a relay subsequent to its original manufacture. A very high flexibility is thus provided.

The first and/or the second contacts also can be designed so that they can be exchanged. For example, the contacts can be designed as plug or clamp contacts. Furthermore, it is also possible for soldered contacts to be removed and new contacts can be soldered. For example, overly severe wear of the contacts can be prevented by a timely exchange.

As mentioned, arbitrary electrical functions or switching functions can be realized by means of the first and the second circuit boards, largely independent of the design of the mechanical actuator. Various designs and production methods known from circuit board technology can be utilized in order to achieve the specific switching function.

For example, it is possible for a component (in particular a radio-frequency component), realized as a circuit board structure to be provided on the first and/or the second circuit board. Naturally it is also possible that a discrete component be provided on the first and/or second circuit board. In this manner it is possible to enable nearly arbitrary circuits on the two circuit boards that employ transistors, capacitors, coils, resistors and other components of electrical engineering. A greater design freedom is provided.

It is also possible for the switch to be completely integrated into the radio-frequency circuit, such that additional interfaces (such as plugs and the like) as well as connection conductors can be entirely omitted. This approach is also conceivable to allow the relay to be adapted as a part of a component. For example, by variation of a conductor surface (for a capacitor) or by alteration of the length of stubs, by means of the relay it is possible to switch properties of a component in various stages corresponding to the contact positions. This can be realized for all components of electrical engineering whose properties are determined by the circuit board structure.

Further techniques known in principle for production and design of circuit boards can also be applied. The first and/or the second circuit board can be fashioned with multiple layers with at least one feedthrough (via). For example, crossovers of conductor traces are thereby possible.

The material of the circuit board as well as materials for the coatings are freely selectable in the framework of the present invention, for which selection the intended use must naturally be considered. The contacts can be produced from any suitable material (for example from copper).

Such a relay can be advantageously used in radio-frequency engineering.

For this purpose, the circuit boards are at least partially (or completely) fashioned from conductor strips. Established methods of radio-frequency engineering can be used in the dimensioning of the conductor traces.

Furthermore, for use in radio-frequency engineering a conductive ground plane can be provided on the side of the first circuit board situated opposite the first conductor traces and/or on the side of the second circuit board situated opposite the second conductor traces.

The mechanical actuator is designed so that it can move in an optimally simple manner to reach the various contact positions, and such that a sufficiently good contact is enabled between the corresponding first and second contacts so that an electrical connection is ensured. Furthermore, it should be designed so that optimally little wear occurs at the contacts and the circuit boards.

The specific design of the mechanical actuator is determined only by the number of the required contact positions, the total size of the arrangement, the requirements for the contact pressure in the contact position and the available drive motors, but is independent of details of the switching function to be realized.

Therefore, in an embodiment of the invention, the mechanical actuator is fashioned for spacing the second circuit board (which is arranged parallel to the first circuit board) from the first circuit board, for rotation of the second circuit board by a specific switching angle associated with a change of the contact position, and for converging the second circuit board on the first circuit board for electrical connection of at least one first contact with at least one second contact in a contact position.

In this embodiment a change of the contact position occurs based on the first circuit board being spaced from the second circuit board and the boards being in parallel to each other. If the second circuit board is arranged above the first circuit board, this is, for example, raised by the mechanical actuator such that the electrical connection between the corresponding first contact or contacts with the corresponding second contact or contacts is broken. In addition, a mechanical contact between the first circuit board and the second circuit board no longer exists. In order to enable a new contacting, the mechanical actuator is also fashioned to move the second circuit board toward the first circuit board (termed "converging" herein to make electrical connection of at least one first contact with at least one second contact. In order to change the contact positions, the mechanical actuator is additionally fashioned for rotation of the second circuit board by a specific switching angle associated with a change of the contact positions. This rotation can occur completely uncoupled from the spacing or converging procedure, but can also be coupled with these procedures. In an embodiment, the spacing is therefore initially effected, then a rotation by a specific angle is implemented that is selected such that the next contact position is reached, and the convergence subsequently occurs. It is alternatively also possible for the spacing and the convergence to ensue, with the rotation by the specific angle proceeding simultaneously during the spacing and the convergence.

The specific switching angle associated with a change of the contact position thereby establishes the number of the contact positions that can be achieved with the mechanical actuator. Given an angle of 180°, two different contact positions are thus conceivable, and six different contact positions are possible given an angle of 60°. It should be noted that the state in which the first circuit board is spaced from the second circuit board can also be used as a switching position in which none of the first contacts is connected with any of the second contacts.

The mechanical actuator can be a linear motor, in particular an electromagnetic linear motor or a piezo-linear motor, or a pneumatic motor (fluid motor) for spacing and converging of the circuit boards. With such linear motors, it is also possible to achieve high contact pressures of the first circuit board on the second circuit board in the contact position, such that low contact resistances can be realized and the relay can also be used for switching of high power capacities, in particular high radio-frequency power capacities.

In the case of linear motors, two different types must be differentiated. Linear motors (for example piezo-linear motors) are available in which every position of the linear motor is positionally stable, meaning that the linear motor stays in the position into which it was driven. Linear motors are also known in which the rest positions are not stable, for example electromagnetic linear motors in which an attraction force is generated such that a deflection in a direction is possible, so the motor tends to return into (for example) a default position again after the deflection. Given a linear motor with unstable rest positions, it is possible for a return element (in particular a spring) to be provided to converge the second circuit board on the first circuit board. A deflection counter to the return force of the return element is then achieved as long as the motor is fed with current, for example, to cause the first circuit board to be spaced from the second circuit board. If the motor is no longer fed with current, the second circuit board is again pressed on the first circuit board with sufficient force due to the return force of the return element. Moreover, such a return element can also serve for adjustment of the contact pressure.

If such a linear motor is provided for spacing and converging of the circuit boards, the mechanical actuator can include a device for automatic rotation of the second circuit board upon spacing and/or converging of the second circuit board on the first circuit board. A coupling of the rotation movement with the linear movement for spacing or for converging thereby ultimately exists. As a drive motor, the linear motor is therefore advantageously sufficient to enable all necessary movements of the second circuit board.

In an embodiment the aforementioned device has a cylinder that is co-movably coupled with the second circuit board as well as a guide tube for guidance of the cylinder. A guidance profile with a number of catch positions corresponding to respective contact positions is fashioned on the inner wall of the guide tube or the outer wall of the cylinder, or at least one guide pin directed into the profile is fashioned on the inner wall of the guide tube. Upon spacing and converging of the circuit boards, the guide rod is directed (urged) by angled guidance surfaces of the guidance profile to a following catch position in which it engages upon convergence of the second circuit board on the first circuit board. In this case the guidance profile is designed such that the axial motion of the cylinder is additionally converted into a rotation by a predetermined angle. For this purpose, guide surfaces are provided in the guidance profile, the guide surfaces causing the guide pin to be directed during the spacing and converging of the second circuit board. The catch positions can be realized as, for example, essentially rectangular slits in a lower part of the guidance profile, which should be designed sufficiently long so that the guide pin does not strike the lower profile edge before the meeting (touching) of the first and second contacts. If the spacing now occurs, for example, if the second circuit board is raised, the guide pin moves upwards until it runs into contact with an angled guidance surface located above the slit in the upper part of the profile, and the guide pin is directed along this guidance surface, causing the second circuit board to begin to rotate. The angled guidance surface ends at a stop that can simultaneously determine (set) the maximum elevation height. Upon lowering (thus converging) of the second circuit board, the guide pin is again directed from this position toward the lower part of the profile where it engages a further angled guidance surface that effects a further rotation of the second circuit board and feeds the guide pin to the next slit, thus the next catch position. The various possible catch settings are established by the catch positions, and due to symmetries it is possible for a contact position to be realized at a number of catch positions. Such a design with suitable guide surfaces can be achieved, for example, by a sawtooth profile. In principle it is also possible to design the (inner) cylinder as fixed and to couple the guidance tube with the second circuit board in terms of movement, but such an execution is mechanically more difficult to realize.

In an alternative to the embodiment with a device for automatic rotation of the second circuit board upon spacing and/or converging of the second circuit board on the first circuit board, the mechanical actuator can include a rotation motor (in particular a step motor) for rotation of the second circuit board. Two motors can be provided. Such a rotation motor has the advantage that it can be activated such that arbitrary contact points (thus arbitrary angles of the second circuit board in comparison to the first circuit board) can be achieved. No fixed contact points are then provided (as would be the case in, for example, the event of a predetermined profile). Instead, the mechanical actuator can be set differently in relation to the number and the position of the contact points. A greater flexibility is thereby provided, but a rotation motor is additionally required.

In the design of relays it is important to ensure that an electrical connection exists between the corresponding at least one first contact and the at least one second contact in every contact position. Not only is a sufficient contact pressure necessary to overcome the electrical responses caused by oxides that form on the surface of the contact mechanical wear of the contacts, but also mechanical inaccuracies (due to manufacturing tolerances) that can prevent a contacting must also be countered.

For addressing these problems, according to the invention, a return element can be provided to adjust the contact pressure of the second circuit board on the first circuit board. This return element can be the return element for the case of a linear motor with unstable rest positions, or a further return element can be provided. this possible further return element can set how strongly the circuit boards (and thus the contacts) are pressed against one another. In the contact positions, at least one first contact always lies opposite at least one second contact, which contacts are to be electrically connected with one another. Upon convergence of the second circuit board on the first circuit board, these meet in contact with one another. In order to obtain an optimally low contact resistance, oxide formation on the contacts can be counteracted by the high contact pressure, since forces that remove the oxides occur upon contacting.

Furthermore, the second circuit board can be fashioned such that it is resilient. Manufacturing tolerances and installation tolerances at the contacts thus can be compensated and a uniform contacting can be ensured since (in particular in connection with a sufficient contact pressure) the second circuit board can deform such that all contacts to be connected are actually made.

In a further embodiment of the invention, the mechanical actuator can include a mounting element (in particular a mounting plate) for attachment of the second circuit board. This mounting element advantageously has the same dimensions as the circuit board, such that elements improving the contacting behavior can be employed. For example, an elastic (resilient) bearing element can be provided between the mounting element and the second circuit board. This additional elastic bearing serves to compensate manufacturing tolerances that disrupt the parallelism of the second circuit board and the first circuit board and thus could prevent a uniform contacting between the contacts. Additionally or alternatively, an elastic spacer can be provided between the second circuit board and the mounting element (possibly, in the event that a bearing element is present, between the second circuit board and the bearing element). Such a spacer can exhibit a geometric shape that improves the contacting behavior of the first and second contacts, as well as allowing greater design possibilities. The spacer may contact the second circuit board only on a portion of its surface, so as to form at least one hollow space. The created hollow spaces can be advantageously utilized. The position of the hollow spaces can correspond to the position of the second contacts on the elastic second circuit board. If the second circuit board is elastic and if a second contact is located opposite a hollow space, the second circuit board can deform somewhat into the hollow space and thus compensate for tolerances. This is particularly appropriate when more than three second contacts should be electrically connected with corresponding first contacts. Namely, three contact points define the plane in which the second circuit board is situated. It may then occur that no uniform contacting is achieved since, for example, a fourth second contact does not contact, or contacts with weaker contact pressure its corresponding first contact. By, in this inventive embodiment, the circuit board being able to deform somewhat into the hollow spaces when a sufficient contact pressure exists, a uniform contacting is nevertheless achieved since a uniform distribution of the contact pressure occurs due to the deformation of the elastic second circuit board that is enabled by the spacer. Alternatively or additionally, at least one discrete component provided on the second circuit board can also be arranged in the hollow space. An optimal space utilization is then possible. Additionally, the projecting discrete components then do not prevent the converging of the second circuit board onto the first circuit board.

A further possibility for improvement of the contacting behavior in accordance with the invention is to fashion the first and/or the second contacts fashioned as spring contacts. The contacts themselves can then consequently yield somewhat in the event that, for example, another contact could not achieve an electrical connection due to manufacturing tolerances.

The inventive relay is suited for applications within magnetic resonance systems. For this application, the relay should be designed such that optimally few field distortions that could interfere with the measurement occur due to the presence of the relay. Therefore, the relay is formed at least in part (in particular mostly) of non-magnetic materials.

As mentioned, the inventive relay allows a large design freedom with regard to the switching functions to be realized. Some examples (that are naturally not exhaustive) are as follows.

The relay having two second strip contacts and a second conductor trace connecting them can be fashioned for selective connection of any two first contacts from a number of first contacts. For example, if three input lines with three first contacts are present, the relay can thus be fashioned such that it connects either the first and the second input lines, the second and the third input lines or the third and the first input lines. This is naturally also possible with a larger number of input lines. The relay can be fashioned as a 1:n multiplexer. For example, in this embodiment a centrally arranged first contact that is associated with a first conductor trace can be selectively connected with a number of further first contacts with associated first conductor traces via the second conductor trace of the second circuit board.

In another variant, the relay having four first contacts, four second contacts and two second conductor traces (whereby any two second contacts are connected via a conductor trace) can be fashioned as a two-way switch. For example, given such a switch the first contact can be connected with the second first contact and the third first contact can be connected with the fourth first contact, or the first contact can be connected with the fourth first contact and the second first contact can be connected with the third first contact.

Another possible switching function is achieved when a first contact can be selectively connected, respectively via a number of second contacts, with any one (at a time) of second conductor traces fashioned as stubs of various lengths. A stub of variable length can be realized in this manner with the relay.

A component that can likewise be switched in various stages is obtained when a first contact can be selectively connected via a number of second contacts with second conductor traces fashioned as conductive surfaces of varying size. For example, a capacitor of variable capacitance can be realized in this manner.

In another alternative embodiment, the relay can be fashioned as a crossbar switch. A crossbar switch has four first contacts, whereby the relay is designed such that it allows either a connection between the second first contact and the third first contact in a first contact position or realizes connections between the first contact and the third first contact as well as the second first contact and the fourth first contact in another contact position. Since conductors must cross for this, a multi-layer circuit board structure is conceivable.

In various further instances, in at least one contact position the relay can additionally have shielded conductors extending across the second circuit board. A good shielding thus can also be achieved with the relay.

The invention also concerns a relay arrangement with a number of inventive relays arranged like a matrix in rows and columns of a relay structure. The relays are actuated by spacing and converging the second circuit board and the first circuit board, and a device is provided for automatic rotation of the second circuit board during the spacing and/or the converging of the circuit boards. The mechanical actuator has a number of first switching rails associated with the rows and second switching rails associated with the columns, the first and second switching rails being arranged perpendicularly to one another. By actuation of a first switching rail, a row of relays is selected for actuation; and by subsequent actuation of a second switching rail the relay characterized by the corresponding row and column is activated. "Activation" of the relay means the changing to another contact position.

In the case of a matrix-like arrangement of a number of relays, the inventive relay that can simply be activated by a force acting perpendicularly to the circuit boards, enables a mechanism to be realized that overall operates with fewer motors or force generators. In the inventive relay arrangement, actuators must be provided only for the first and second switching rails, but not for each individual relay. For example, a relay arrangement with n columns and m rows can be realized, for which n+m actuators (in particular motors) are required.

Aside from the necessity of the device for automatic rotation, the relay can naturally encompass all embodiments that have been discussed above.

For example, the device can have a cylinder coupled for co-movement with the second circuit board as well as a guide tube for guidance of the cylinder, with a guidance profile with a number of catch positions corresponding to contact positions being fashioned on the inner wall of the guide tube or the outer wall of the cylinder, or at least one guide pin directed into the profile is fashioned on the inner wall of the guide tube. Upon spacing and converging of the circuit boards, the guide rod is directed by angled guidance surfaces of the guidance profile to a following catch position in which it engages given convergence of the second circuit board on the first circuit board. This embodiment was already discussed above.

In another embodiment of the relay arrangement, coupling devices can be provided on the first switching rail, and a coupling device couples the relay to the second switching rail upon actuation of the first switching rail. The coupling device can have a first actuating pin and a second actuating pin. Upon coupling, the first actuating pin is accepted with positive fit by a corresponding opening on the relay and the second actuating pin is accepted in a profile opening at the second switching rail, the profile opening being fashioned for translation of the force of the second switching rail into a force directed perpendicularly thereto for spacing and converging of the first and second circuit boards. The profile opening (similar to the guidance profile) then exhibits an angled guidance surface that serves for conversion of the movement of the second switching rail into a force suitable for spacing and converging of the second circuit board on the first circuit board. For example, the profile opening can be an angled channel, so the actuation of the relay (which is coupled via the coupling device to the second switching rail) ensues by a movement of the second switching rail back and forth. The spacing occurs upon movement of the second switching rail forward, the converging occurs upon backward movement of the same guidance element.

The coupling device can also appropriately have a resilient element for compensation of the movement of the coupling device for actuation of the relay counter to the first switching rail that is immobile in this direction. Although the first switching rail couples a relay of one row to the corresponding second switching rail via the coupling device attached thereto, it can itself be moved only in its movement direction. Upon actuation of the second switching rail, however, the coupling device is moved at least partially into a direction perpendicular thereto in which the first switching rail is immobile. A resilient element (in particular a spring) can be provided to enable this movement in spite of the first switching rails being immobile. By its return force, this resilient element can advantageously also serve as a drive means for the convergence movement of the second circuit board toward the first circuit board.

The first circuit boards of the individual relays can be fashioned as part of a common first circuit board spanning the matrix-like relay structure. If there is only one common first circuit board, cablings that would otherwise have been necessary between the individual relays are advantageously omitted. Moreover, simpler manufacturing is enabled.

For stabilization of the switching rails, the switching rails can be borne in a sliding manner in mechanical bearings adjacent to the matrix-like relay structure. Such a bearing that has openings that correspond to the cross-section of the switching rails, can serve to support a number of first or second switching rails. If these bearings are provided on both sides of the relay structure, a stable arrangement with little play is provided that enables a secure switching of the relay.

As mentioned, each switching rail can have a motor associated therewith (in particular a linear motor) that drives the rail. Piezo-motors also lend themselves to this since the actuation lengths of the switching rails do not have to be large. However, it is naturally also conceivable to use a normal electromotor.

If, for example, the relay arrangement should be used in a magnetic resonance system where the measurement may not be disrupted by scatter fields, the relay arrangement is composed at least in part (in particular mostly) non-magnetic materials.

In a special application, the relay can be fashioned as a crossbar switch. Such crossbar distributors for the most part exhibit n×n nodes, whereby each of the nodes is formed by a crossbar switch.

The contact force and the compensation of manufacturing tolerances also play a large role in the inventive relay arrangement for which the inventive solutions that have already been discussed with regard to the relay can also be employed. Thus the second circuit boards can be fashioned so that they are resilient. Additionally or alternatively, the mechanical actuator can have mounting elements (in particular a mounting plate) for retention of the second circuit board. An elastic bearing element can be provided between the mounting element and the second circuit board. In addition or as an alternative to the bearing element, an in particular elastic spacer can be provided between the second circuit board and the mounting element (possibly, in the event that it is present, between the second circuit board and the bearing element). This spacer can contact the second circuit board only on a portion of its surface to form at least one hollow space. The position of the hollow spaces can correspond to the position of the second contacts on the elastic second circuit board. Alternatively or additionally, at least one discrete component provided on the second circuit board can be arranged in the hollow space. Finally, given the relay arrangement it is also possible for the first and/or the second contacts to be fashioned as spring contacts.

A number of possibilities to realize the most varied switching functions are available here with regard to the embodiment of the relay.

In more complex arrangements of inventive relays (for example, when the relays are arranged not like a matrix, in rows and columns, but rather are arranged on a more complex common first circuit board structure), an x-y drive resembling those that are used in a plotter can be used for actuation of the relays, for example. Such an x-y drive then approaches the position above a relay and can manipulate the corresponding relay from there, for example by means of an actuation pin.

DESCRIPTION OF THE PREFERRED EMBODIMENTS

Figure 1:
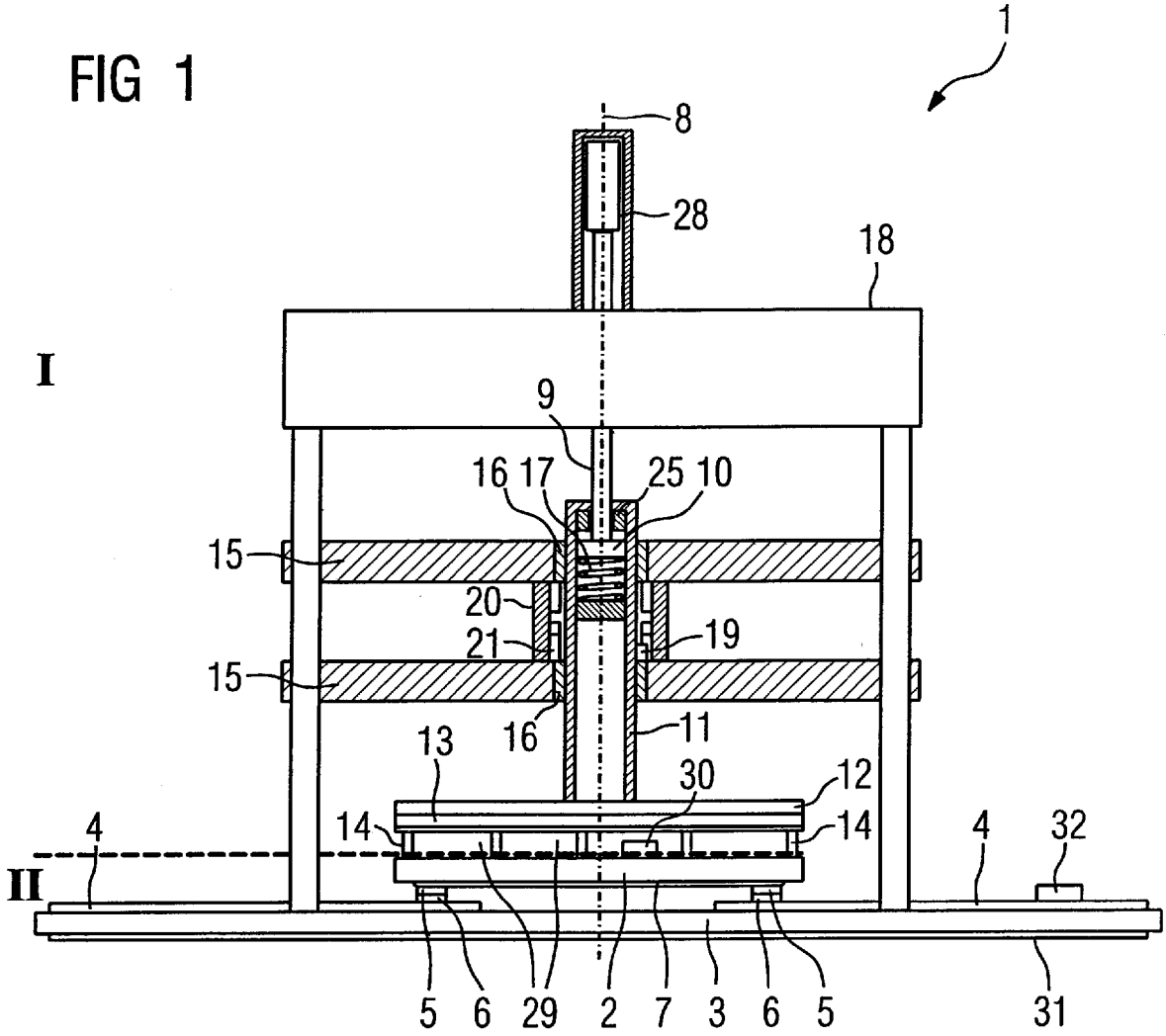
FIG. 1 shows a section through an inventive relay.

FIG. 1 shows a cross-section through an inventive relay 1. It has a mechanical actuator primarily arranged in region I with which a second circuit board 2 can be moved against a first circuit board 3 such that the second circuit board can occupy various contact positions.

The first circuit board 3 has first conductor traces 4 that are electrically connected with first contacts 5. In one contact position the second circuit board 2 is pressed against the first circuit board 3 such that second contacts 6 of the second circuit board 2 (which are in turn electrically connected with second conductor traces 7) come in contact with selected first contacts 5 such that an electrical connection is provided. Different first contacts 5 contact different second contacts 6 in different contact positions.

The entire electrical switching function is accordingly defined by the two circuit boards 2 and 3 that are associated with the region II.

The mechanical actuator in region I are now fashioned to move the second circuit board 2 (which is arranged parallel to the first circuit board 3) into another contact position upon actuation of the relay 1. For this purpose, the second circuit board 2 is initially spaced from the first circuit board 3 (thus is raised), whereby it is already rotated around a center axis 8 during this raising. The second circuit board 2 is subsequently converged again on the first circuit board 3 (thus is lowered), whereby the remaining rotation is implemented so that a rotation angle results in total that corresponds to a change of the switching angle associated with the contact position. During the raising and lowering of the second circuit board 2, this is accordingly rotated by the switching angle. It is subsequently located in a different contact position such that an electrical connection exists between different first contacts 5 and second contacts 6.

The embodiment of the mechanical actuator should now be explained in detail in the following. The relay comprises two movable systems for the switching procedure just described. Provided first is an actuation system that includes the switching rod 9 and the plunger 10 rigidly connected with said switching rod 9. Coupled with said actuation system via the plunger 10 is the support system that has a cylinder 11 and a mounting element 12 rigidly connected with said cylinder 11, on which support system are in turn rigidly mounted a resilient bearing 13, a spacer 14 and the second circuit board 2. The cylinder 11 is therewith overall coupled with the second circuit board 2 in terms of movement.

The actuation system can move only in the axial direction (thus perpendicular to the circuit boards 2, 3 along the axis 8) while the support system can also rotate around the axis 8 in addition to the movement in the axial direction. Bearings 16 arranged on support elements 15 are provided to enable the rotation.

The actuation system and the support system are coupled with one another in the axial direction via the plunger 10. A rigid coupling can be provided, but as in this exemplary embodiment, a return element 17 (here in the form of a spring) can also be interposed. The return element 17 serves for the generation of a measured contact pressure of the second circuit board 2 on the first circuit board 3 so that a secure and good contacting is achieved. The actuation system and the support system together form an axial switching system which is the single movable system of the relay.

A linear motor 18 is provided for actuation of the axial switching system. The spacing and converging between the second circuit board 2 and the first circuit board 3 are enabled via the linear motor 18. For this purpose, the linear motor 18 can move the axial switching system into two stable positions via the switching rod 9 of the actuation system. In the contact position the second circuit board 2 is pressed against the first circuit board 3 so that at least one first contact 5 is electrically connected with at least one second contact 6. The contact position is accordingly achieved by the abutting of the second circuit board 2, namely its second contacts 6, against the first contact 5 of the stationary first circuit board 3.

The second stable position results from the embodiment of a device for automatic rotation of the second circuit board 2 upon spacing and converging of the second circuit board 2 on the first circuit board 3, which embodiment should be described in detail in the following. In addition to the aforementioned cylinder 11 to which a guide pin 19 is attached, the device has a guide tube 20 on whose inner side is provided a profile 21 in which the guide pin 19 is directed.

Figure 2:
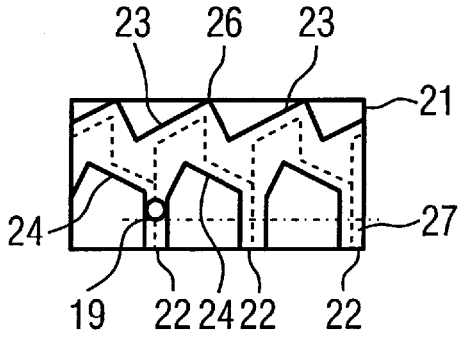
FIG. 2 shows a guidance profile used in the relay according to FIG. 1.

The profile 21 is presented in detail in "unwound" form in FIG. 2. In this example it has three catch positions 22 in which the guide pin 19 engages in the respective contact positions. The catch positions 22 are fashioned as slits whose shape extending downwards should prevent that the guide pin 19 already strikes the lower edge of the catch positions 22 before the meeting of the second circuit board 2 on the first circuit board 3.

Furthermore, angled guidance surfaces fashioned as inclines 23 and 24 are provided in the profile that enable the rotation of the support system (and thus of the second circuit board 2) around the axis 8. Thus, if the actuation system moves upward from the switching rod 9 and the plunger 10 due to an actuation of the linear motor 18, due to an interaction with an inner surface 25 of the cylinder 11 this (and with it the guide pin 19) also moves upward. The guide pin 19 then abuts on the incline 23 and is moved along it via the force of the linear motor 18, whereby the cylinder 11 (and thus the second circuit board 2) rotates relative to the stationary support tube 20 (and thus also the first circuit board 3). Finally, the guide pin 19 reaches the position 26 (thus the uppermost point of the profile 21) that defines the second stable position already mentioned above. The stoppage of the guide pin 19 at the position 26 accordingly limits the spacing movement of the second circuit board 2. In order to conclude the actuation of the relay 1, the actuation system is now again moved downward such that the support system is also pressed downward over the return element 17. The guide pin 19 thus moves downward in the profile 21 until it strikes the incline 24 via which a further rotation movement of the support system (and therewith of the second circuit board 2) is generated. Moreover, the guide pin 19 is fed via the inclination 24 to the next catch position 22 that is located below an adjacent incline 23. The guide pin then enters into the slit of the catch position 22 until the corresponding second contacts 6 touch the corresponding first contacts 5. Overall a sawtooth-like structure results for the profile 21. The path 27 that the guide pin 19 covers along the profile 21 is shown dashed in FIG. 2.

It can accordingly be learned from FIG. 2 that, based on the symmetry of the profile 21, three respectively identically spaced catch positions 22 are present, such that the switching angle here is respectively 120°. This means that three different contact positions can be set that are respectively associated with one of the catch positions 22. However, the profile 22 shown in FIG. 2 is to be viewed only as an example; naturally, profiles are also conceivable that exhibit a greater number of catch positions and thus more possible contact positions. Asymmetrical profiles are also conceivable in which different switching angles are traversed between the differed catch positions.

Furthermore, at this point it is to be noted that naturally the neutral position (thus when the guide pin 19 is located at the uppermost position 26 of the profile 21 and the second circuit board 2 is spaced from the first circuit board 3) can represent a relevant switching position.

Only one guide pin 19 is used in the relay 1. Two or more guide pins can be used when the symmetrical pattern in the guidance profile 21 is duplicated or copied at the same time.

The employed linear motor 18 can be a piezo-linear motor, a pneumatic linear motor (also called a fluid drive) or also an electromagnetic linear motor. The linear motor 18 can advantageously be actively moved in both directions along the axis 8 and possesses sufficient retention forces in the stable positions of the axial switching system. In this case the contact pressure of the contacts 6 on the contacts 5 is generated by the return element 17, as mentioned above.

However, linear motors 18 can also be used that can be actively moved only in one direction and has no retention force in the rest position. In this case a return element 28 (likewise shown in FIG. 1) is provided which serves on the one hand for the adjustment of the contact pressure, however on the other hand also serves to move the switching rod 9 and the plunger 10 downward again after a corresponding deflection of the linear motor 18, such that the corresponding contact position is reached. Naturally, it is also conceivable that both return elements 17 and 28 are provided. A sufficiently high contact pressure is very important to ensure sufficient contacting since, due to oxidation or mechanical manufacturing tolerances or, respectively, mounting tolerances, the possibility exists that no contacting occurs or a too-high contact resistance occurs. In order to further counteract the tolerances, the relay 1 comprises an ingenious elastic bearing system that can compensate for such manufacturing tolerances or mounting tolerances. An additional resilient bearing 13 is thus additionally provided which compensates for tolerances that interfere with the parallelism of the first circuit board 3 and the second circuit board 2 and thus could prevent a uniform contacting between the switch contacts.

In particular for a relay 1 with a number of first contacts 5 and second contacts 6, due to manufacturing tolerances and mounting tolerances of the contacts 5, 6 themselves, it can furthermore occur that a uniform contacting is no longer ensured due to, for example, differing heights of the contacts. The second circuit board 2 is designed so that it is resilient. The spacer 14 now contacts the second circuit board 2 not on its entire surface but rather only in parts, such that hollow spaces 29 are created. These hollow spaces 29 can serve two purposes. On the one hand, the hollow spaces 29 are fashioned opposite the second contacts such that, for example, given a second contact 5 or corresponding first contact 6 fashioned too high the resilient circuit board 2 can bend into the hollow space 29 somewhat, so this height tolerance is compensated. The hollow spaces 29 also serve to accommodate discrete electrical components 30 provided on the second circuit board 2. These then do not prevent the pressing of the second circuit board 2 onto the first circuit board 3.

Any design freedoms are provided in the embodiment of the first circuit board 3 and the second circuit board 2. For radio-frequency applications it can thus be provided that a ground plane 31 is provided on the underside of the first circuit board 3. In addition to this, any components 32 that can be realized via circuit board structures on the first and/or second circuit board 2, 3 can be provided in addition to the aforementioned discrete components 30 that can naturally also be accommodated on the first circuit board 3.

With the inventive relay 1, it has been successful to largely separate the mechanical components in region I (reference characters 9-28) from the electrical switching function that is essentially determined by the circuit boards 2 and 3. In particular, the first circuit board 3 and the second circuit board 2 (which can, for example, be bolted, glued or riveted) are designed such that they can be exchanged. In the shown relay 1 the mechanism merely provides the number of the contact positions and the contact angles.

Instead of the device for automatic rotation with the guide pin 19 interacting with the guidance profile 21 it is also conceivable to provide a rotation motor (in particular a step motor) that can ultimately also realize other switching angles via a suitable activation. Furthermore, it is naturally also possible to also design the guidance profile 19 or, respectively, the guide tube 20 such that it can be exchanged.

Figure 3:
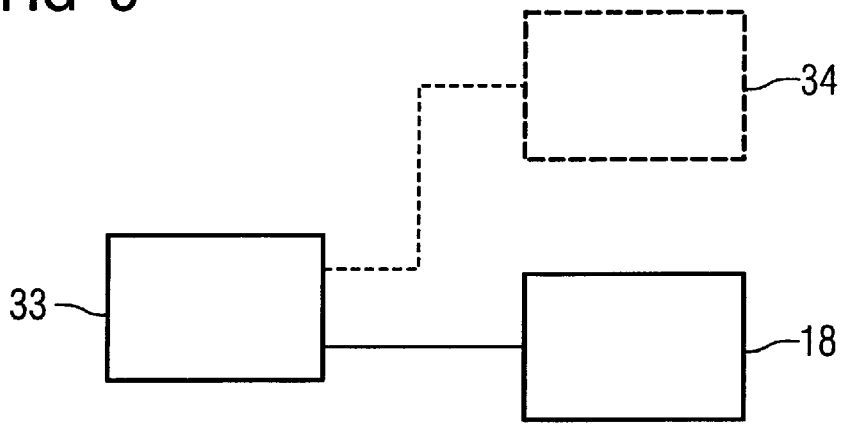
FIG. 3 shows the control electronics used in the inventive relay.

FIG. 3 shows the control electronic 33 for the relay 1. The control electronic 33 controls the linear motor 18. If a rotation motor 34 is additionally provided, this can also be activated by the control electronic 33.

Figure 4A:
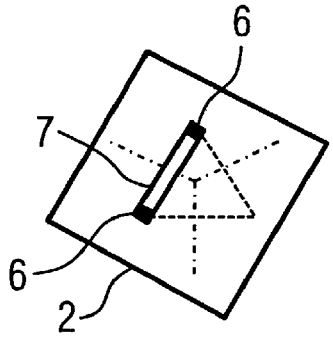
FIG. 4A schematically illustrates a principle drawing of the second circuit board of the relay according to FIG. 1.
Figure 4B:
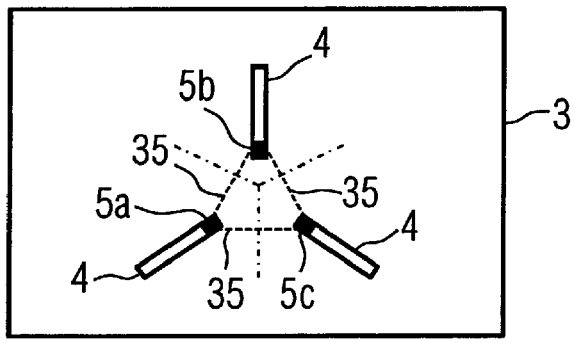
FIG. 4B schematically the first circuit board of the relay according to FIG. 1.

FIGS. 4A and 4B show a principle drawing of the first circuit board 3 and second circuit board 2 that can be used in the relay from FIG. 1 with the switching angle of 120°. A second conductor trace 7 is provided that connects the two second contacts 6. For purposes of the example, the discrete component 30 drawn in FIG. 1 is not provided on this special embodiment of the second circuit board 2.

The first circuit board 3 presented in FIG. 4B comprises first conductor traces 4 that here are shown only in part. These are connected with first contacts 5*a*, 5*b* and 5*c*. The dashed lines 35 in FIGS. 4A and 4B indicate how the second contacts 6 and the second conductor trace 7 can be oriented in the various contact positions. The first contacts 5*a* and 5*b* are connected with one another in the contact position shown in FIG. 4A. If the second circuit board 2 is further rotated by the switching angle of 120° (thus is moved into the next contact position by means of the profile 21), the first contacts 5*b* and 5*c* are thus connected. The contacts 5*c* and 5*a* are connected in the third contact position.

Naturally, a number of further circuit board layouts are conceivable, of which some are discussed below.

Figure 5:
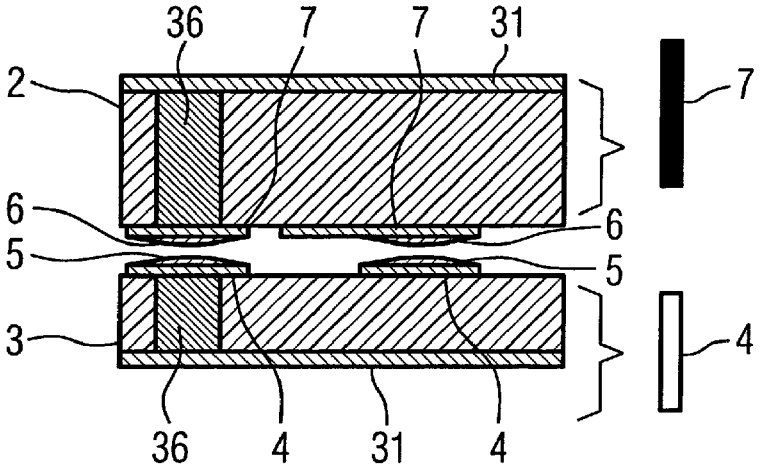
FIG. 5 shows a cross-section through first and second circuit boards that can be used in the inventive relay.

FIG. 5 shows a cross-section through the circuit boards 2 and 3. Presented are exemplary contacts 5, 6 that here are fashioned as simple elevations. The contacts 5, 6 are applied on conductor traces 4, 7 by special coating methods. It is also conceivable to populate the contacts 5, 6 like electrical components on the corresponding circuit boards 3, 2. They can then in particular also be fashioned such that they can be exchanged, such that oxidized or worn contacts 5, 6 can be exchanged.

In the case of a relay 1 produced for radio-frequency applications, the conductor paths 4, 7 will be fashioned as conductor traces, whereupon a conductive ground plane 31 is additionally mounted on the lower side of the first circuit board 3 as well as on the upper side of the second circuit board 2.

Furthermore, feedthroughs 36, the production of which is generally known and thus need not be explained in detail herein, are shown as an example in FIG. 5.

Such feedthroughs 36 and additional contacts 5 and 6 can be used to connect the upper and lower ground planes with one another in a conductive manner.

Figure 6:
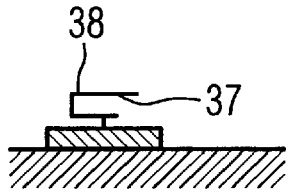
FIG. 6 illustrates a contact executed as a spring contact.

An alternative embodiment of a contact 37 as a spring contact 38 is shown in FIG. 6. Such spring contacts 38 also serve for the compensation of manufacturing and mounting tolerances since they are suitably variable in terms of their height.

FIGS. 7 through 12 respectively show possible switching functions and how these are realized. FIG. A thereby respectively shows a principle drawing of the conductor traces for the specific switching function, FIG. B shows the circuit diagram associated with FIG. A. In order to achieve a greater clarity, the depiction of the contacts themselves was respectively foregone in the Figures. The first conductor traces 4 are accordingly depicted only in outline and the second conductor traces 7 are depicted shaded. While the second conductor traces 7 are presented completely, only the parts of the first conductor traces 7 that are relevant for the respective switching function are shown. The association of the conductor traces 4, 7 with the circuit boards 3, 2 as well as their depiction is also indicated to the right in FIG. 5.

Figure 7A:
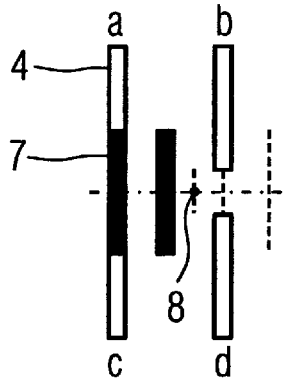
FIG. 7A schematically illustrates the conductor traces for a first switching function.
Figure 7B:
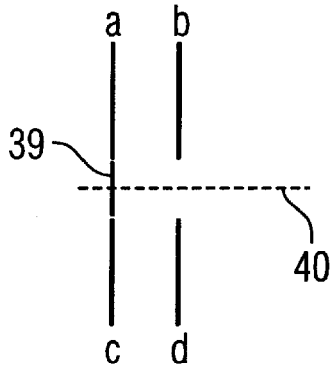
FIG. 7B shows the circuit diagram associated with FIG. 7A.

FIGS. 7A and 7B shows an embodiment of a relay with two various contact positions, whereby the switching angle here is 180°. Here, as in the drawn rotation axis 8 that stands perpendicular to the presentation, the switching function is to be perceived such that either a connection between a and c is enabled in the first contact position or a connection between b and d is enabled in the second contact position. The corresponding switching function results from FIG. 7B via displacement of the bar 39 along the direction indicated by the dashed line 40. In the following Figures a similar depiction is respectively used, such that the reference characters can largely be omitted for reasons of clarity.

Figure 8A:
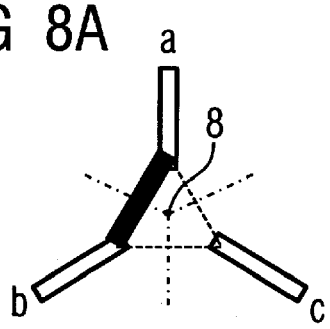
FIG. 8A schematically illustrates the conductor traces for a second switching function.
Figure 8B:
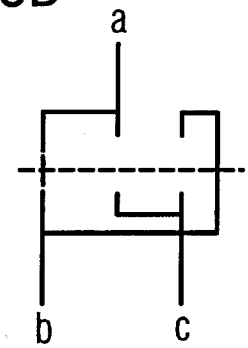
FIG. 8B shows the circuit diagram associated with FIG. 8A.

FIG. 8 shows a further embodiment of a relay that exhibits three contact positions and requires a switching angle of 120°. a and b, a and c or b and c can therewith selectively be connected.

Figure 9A:
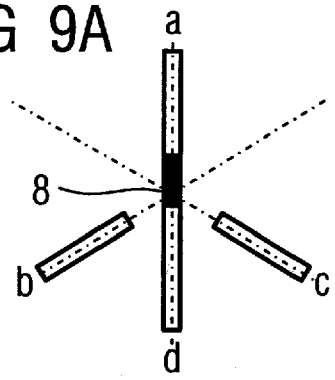
FIG. 9A schematically illustrates the conductor traces for a third switching function.
Figure 9B:
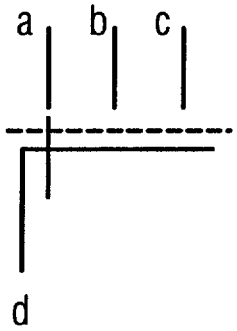
FIG. 9B shows the circuit diagram associated with FIG. 9A.

FIG. 9 shows the embodiment of a relay as a 1:3 multiplexer. Three contact positions are provided; the switching angle is 120°. d can selectively be connected with a, b or c.

Figure 10A:
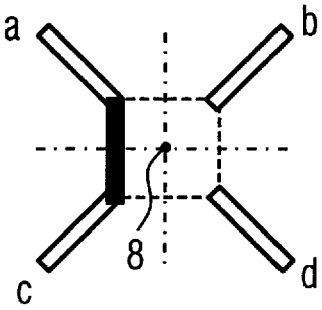
FIG. 10A schematically illustrates the conductor traces for a fourth switching function.
Figure 10B:
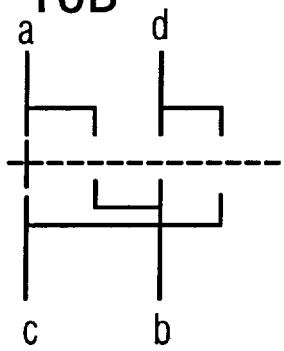
FIG. 10B shows the circuit diagram associated with FIG. 10A.

FIG. 10 shows a relay that exhibits four contact positions and provides a switching angle of 90°. In this case a and b, a and c, b and d and c and d can thereby be selectively connected.

Figure 11A:
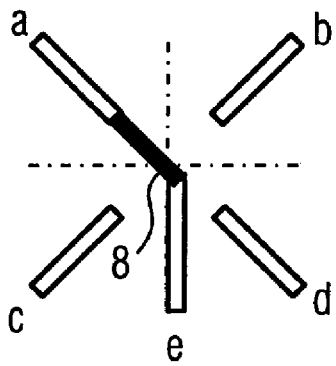
FIG. 11A schematically illustrates the conductor traces for a fifth switching function.
Figure 11B:
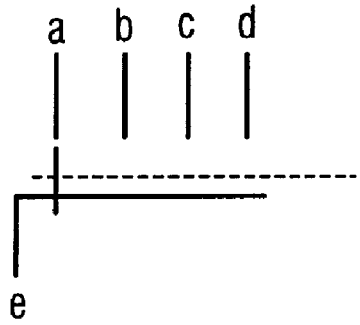
FIG. 11B shows the circuit diagram associated with FIG. 11A.

FIG. 11 shows an embodiment of the relay as a 1:4 multiplexer. The central first conductor trace e can be selectively connected with a, b, c or d in the four contact positions given a switching angle of 90°.

Figure 12A:
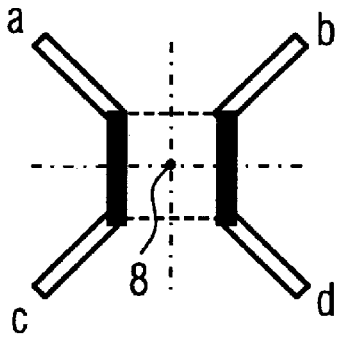
FIG. 12A schematically illustrates the conductor traces for a sixth switching function.
Figure 12B:
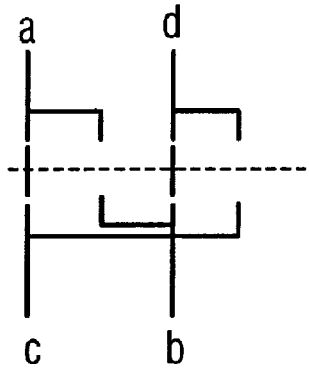
FIG. 12B shows the circuit diagram associated with FIG. 12A.

FIG. 12 shows a relay with four contact positions, whereby every two contact positions are functionally identical. The switching angle is 90°. This relay is fashioned as a 2-way switch, meaning that either a and c as well as b and d or a and b as well as c and d can be connected.

Figure 13:
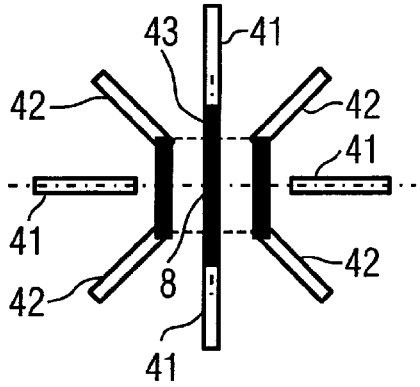
FIG. 13 schematically illustrates the conductor traces for a seventh switching function.

FIG. 13 shows a relay with four contact positions, of which every two contact positions are functionally identical. The switching angle is 90°. This relay acts like a 2-way switch. A shielded conductor 41 can be continued between the paths 42 by means of the middle second conductor trace 43. On the first circuit board 3 the shielded conductors 41 can, for example, be connected with the possible underlying ground plane 31 via feedthroughs 36.

Figure 14:
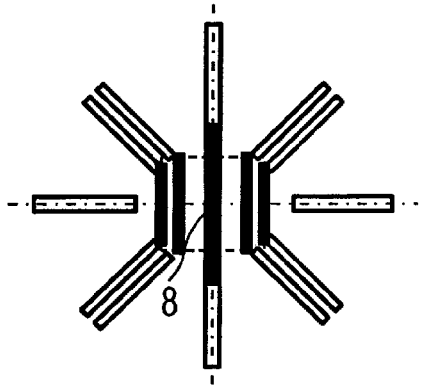
FIG. 14 schematically illustrates the conductor traces for a eighth switching function.

FIG. 14 shows a further relay with four contact positions, of which every two contact positions are functionally identical. The switching angle here is also 90°. A 2-channel 2-way switch therewith results, whereby again a shielded conductor is continued between the respective paths.

Figure 15:
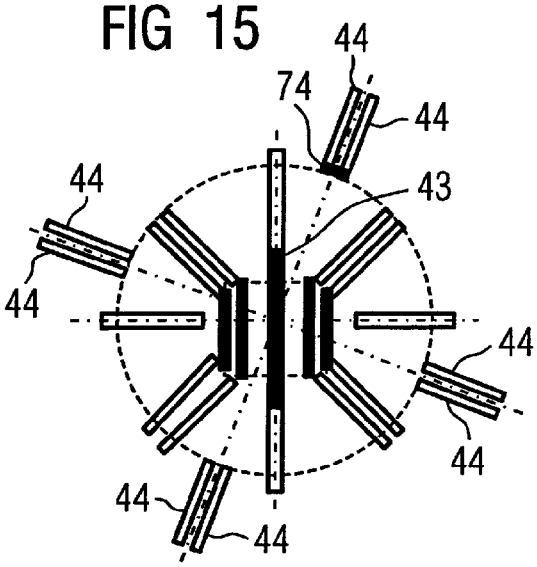
FIG. 15 schematically illustrates the conductor traces for a ninth switching function.

FIG. 15 shows a further relay with four positions in which every two positions are functionally identical. The switching angle is again 90°. The switching function essentially corresponds to the 2-channel 2-way switch from FIG. 14 with shielded conductor between the two paths; however, here an auxiliary switch segment 74 is provided under the second conductor traces, the auxiliary switch segment 74 serves for connection of auxiliary switch conductor traces 44 such that a feedback ensues as to in which contact position the second circuit board is presently located.

Figure 16:
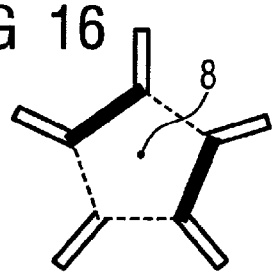
FIG. 16 schematically illustrates the conductor traces for a tenth switching function.
Figure 17:
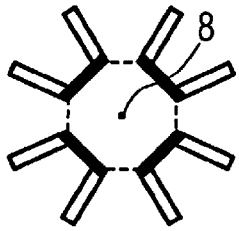
FIG. 17 schematically illustrates the conductor traces for a eleventh switching function.

FIG. 16 shows a relay with five contact positions, whereby the switching angle here is 72°. FIG. 17 shows a further relay in which 8 contact positions are provided, whereby every four contact positions are functionally identical. The switching angle is 45°.

Figure 18:
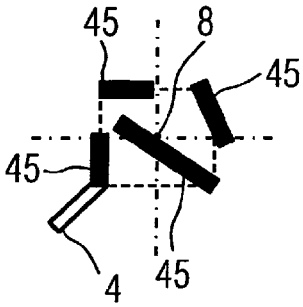
FIG. 18 schematically illustrates the conductor traces for a twelfth switching function.

FIG. 18 shows a relay that can serve for stepped adjustment of a component (here a stub). Second conductor traces fashioned here as stubs 45 of various length are provided on the second circuit board 2. These can be selectively connected with the first conductor trace 4. A stub that can be adjusted in steps in terms of its length is therewith obtained.

Figure 19:
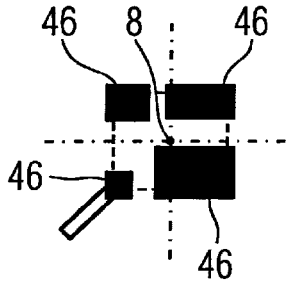
FIG. 19 schematically illustrates the conductor traces for a thirteenth switching function.

FIG. 19 shows a further component that can be switched in steps that is realized via a relay. Four positions with a switching angle of 90° are hereby provided, whereby the second conductor traces here are fashioned as conductive surfaces 46 of various size, such that a capacitance with a different value is respectively obtained in the different contact positions.

Figure 20:
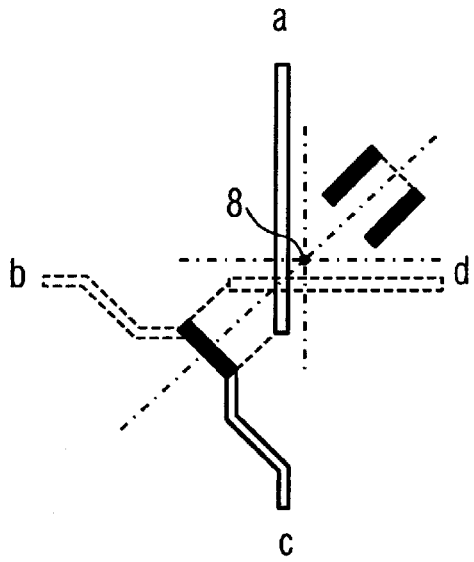
FIG. 20 schematically illustrates the conductor traces given a crossbar switch.
Figure 21:
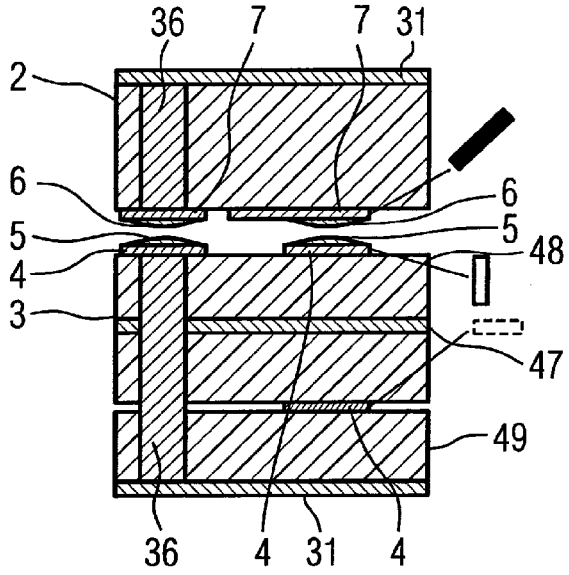
FIG. 21 shows circuit board structures used in the crossbar switch from FIG. 20.

FIG. 20 shows a principle drawing of the conductor traces for a crossbar switch. This relay exhibits two contact positions; the switching angle is 180°. A connection can clearly be achieved between b and c, or even a connection between b and d as well as a and c. Clearly, to obtain this switching function the first conductor traces a and d must cross. For this reason a multi-layer design of the first circuit board 3 is necessary here, as is presented by way of example in FIG. 21. Two planes 48, 49 separated by a ground layer 47 are thereby provided for first conductor traces 4 in the first circuit board 3. First contacts 5 can be connected with the first conductor traces 4 (shown dashed in FIG. 20) of the lower plane 49 via feedthroughs 36. (Not shown here, but naturally present in practice. Shown in the FIG. 20 is only the feedthrough which connects ground planes to contacts.) In FIG. 20 the conductor traces b and d are accordingly arranged on the lower plane 49.

Figure 22A:
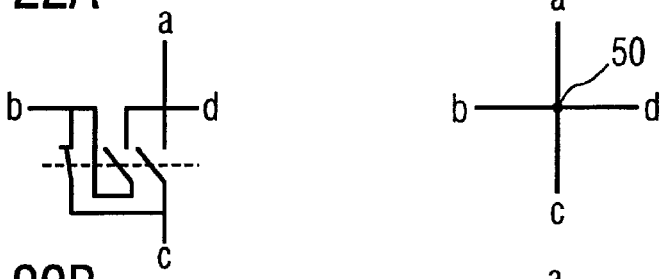
FIGS. 22*a* and 22B show circuit diagrams for explanation of the function of the crossbar switch.
Figure 22B:
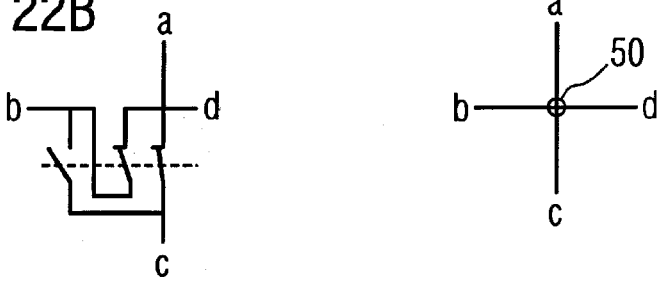

FIGS. 22A and 22B are circuit diagrams that show what is known as an "activated" crossbar switch (FIG. 22A) as well as what is known as a "non-activated" crossbar switch (FIG. 22B). Depictions of the activated or, respectively, non-activated crossbar switch as they are used for the nodes 50 formed by a crossbar switch are respectively shown to the right.

Figure 23:
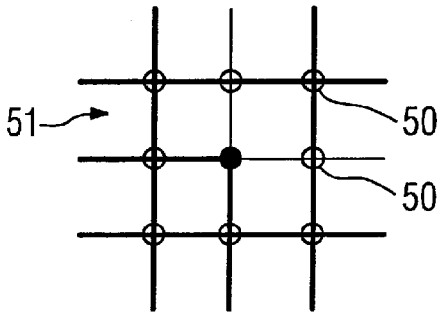
FIG. 23 schematically illustrates the function of a crossbar distributor.

A crossbar distribution as it is frequently used in radio-frequency engineering is presented in principle in FIG. 23. In it a plurality of crossbar switches are interconnected into a crossbar distribution 51 with 3×3 nodes 50. Currently only the central node 50 is visibly activated.

Such a crossbar distribution 51 can, for example, be realized via an inventive relay arrangement without elaborate wiring and with only a few actuators. This should be explained in detail in the following in FIG. 24 through 26.

Figure 24:
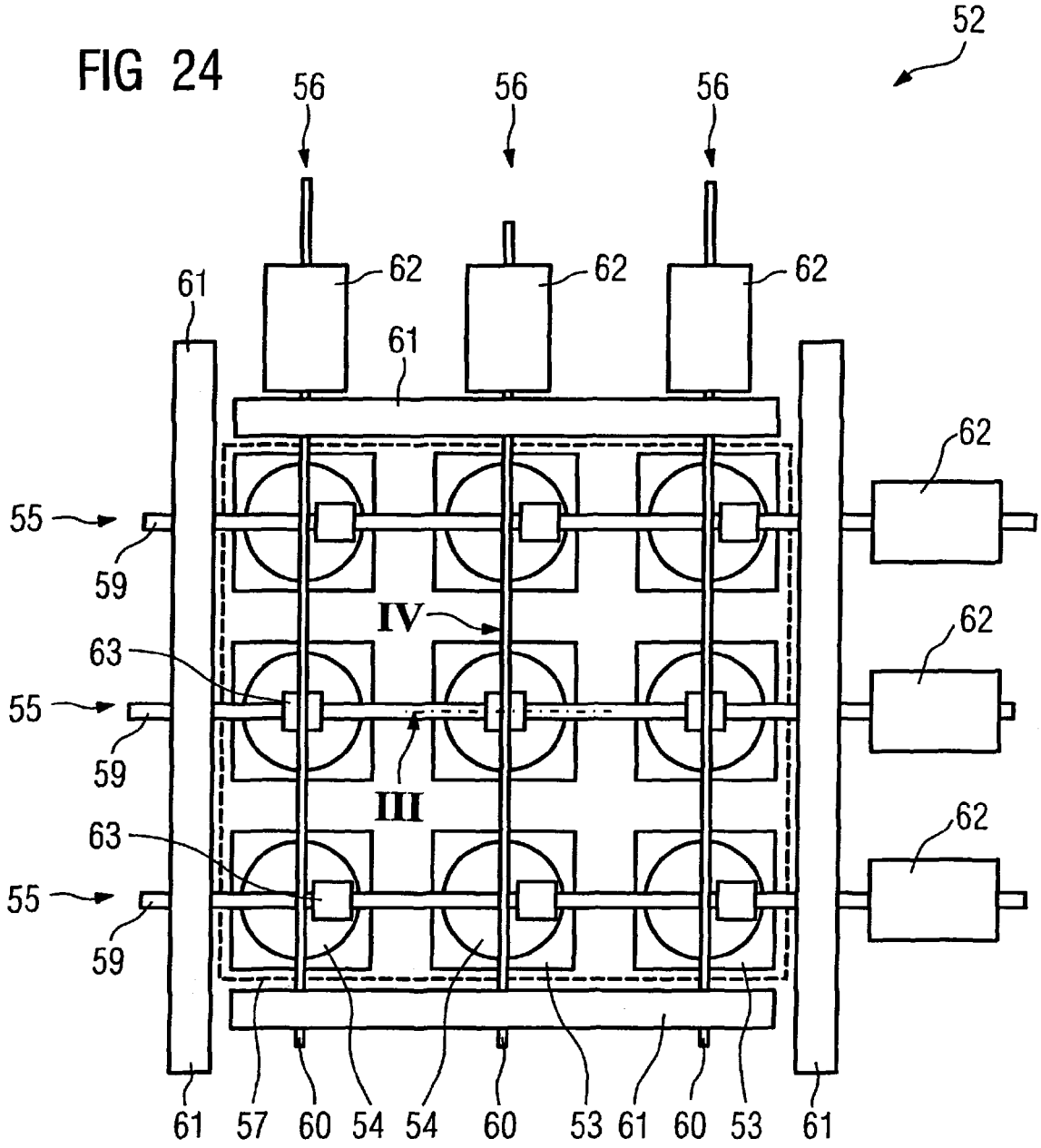
FIG. 24 is a plan view of an inventive relay arrangement.

FIG. 24 shows an inventive relay arrangement 52 in which nine inventive relays 53 (here crossbar switches 54) are arranged in a matrix-like relay structure comprising rows 55 and columns 56. These relays 53 are designed analogous to the relay 1 shown in FIG. 1, consequently respectively comprise a stationary first circuit board and a second circuit board that can be moved counter to said stationary first circuit board, the layout of which second circuit board with the contacts and the conductor traces can, for example, be learned from FIG. 20. However, it is thereby provided that the first circuit boards of the individual relays 53 are fashioned as part of a common first circuit board 57 spanning the matrix-like relay structure, which common first circuit board 57 is indicated dashed in FIG. 24.

The relays 53 are actuated via spacing and converging of the second circuit board and the first circuit board, whereby an actuation in this case means that a change of the contact position occurs. The crossbar switch 54 is accordingly switched over from an activated state into a non-activated state or from a non-activated state into an activated state. A device for automatic rotation of the second circuit board during the spacing and the converging of the circuit board is thereby provided. As already presented in FIG. 1, this device can essentially comprise a cylinder movement-coupled with the second circuit board as well as a guide tube for guidance of the cylinder, whereby a guidance profile with two catch positions (corresponding to a contact position) is fashioned on the inner wall of the guide tube and a guide pin directed in the profile is fashioned on the outer wall of the cylinder, whereby here as well the guide pin is fed to a following catch position by suitable guidance surfaces of the guidance profile upon spacing and converging of the circuit boards, in which catch position said guide pin engages upon convergence of the second circuit board on the first circuit board. The functional principle of this device was already explained in detail with reference to FIGS. 1 and 2 and need not be repeated.

In contrast to the relay 1 the relays 53 are not respectively individually actuated by a linear motor or another drive means; rather, the switching rod 58 (corresponding to the switching rod 9; see FIGS. 25 and 26) of the relays 53 is actuated via an ingenious switching rail system.

First switching rails 59 associated with the rows 55 and second switching rails 60 associated with the columns 56 are thereby provided that respectively cross above the switching rod 58 of the relays 53. The switching rails 59 and 60 are respectively borne such that they can slide in mechanical bearings 61 adjacent to the matrix-like relay structure. Additionally, an actuating motor (in this case a linear motor 62) is associated with each switching rail. Only six motors 62 are therefore required for the actuation of the nine relays 53.

By actuation of a first switching rail 59, a row 55 of relays 53 is now selected for actuation, and the relay 53 characterized by the corresponding row 55 and column 56 is actuated via subsequently actuation of a second switching rail 60. This occurs with the aid of coupling devices 63 that are attached to the first switching rails 59 and couple the relay 53 to the corresponding second switching rail 60 upon actuation of a first switching rail 59.

Figure 25:
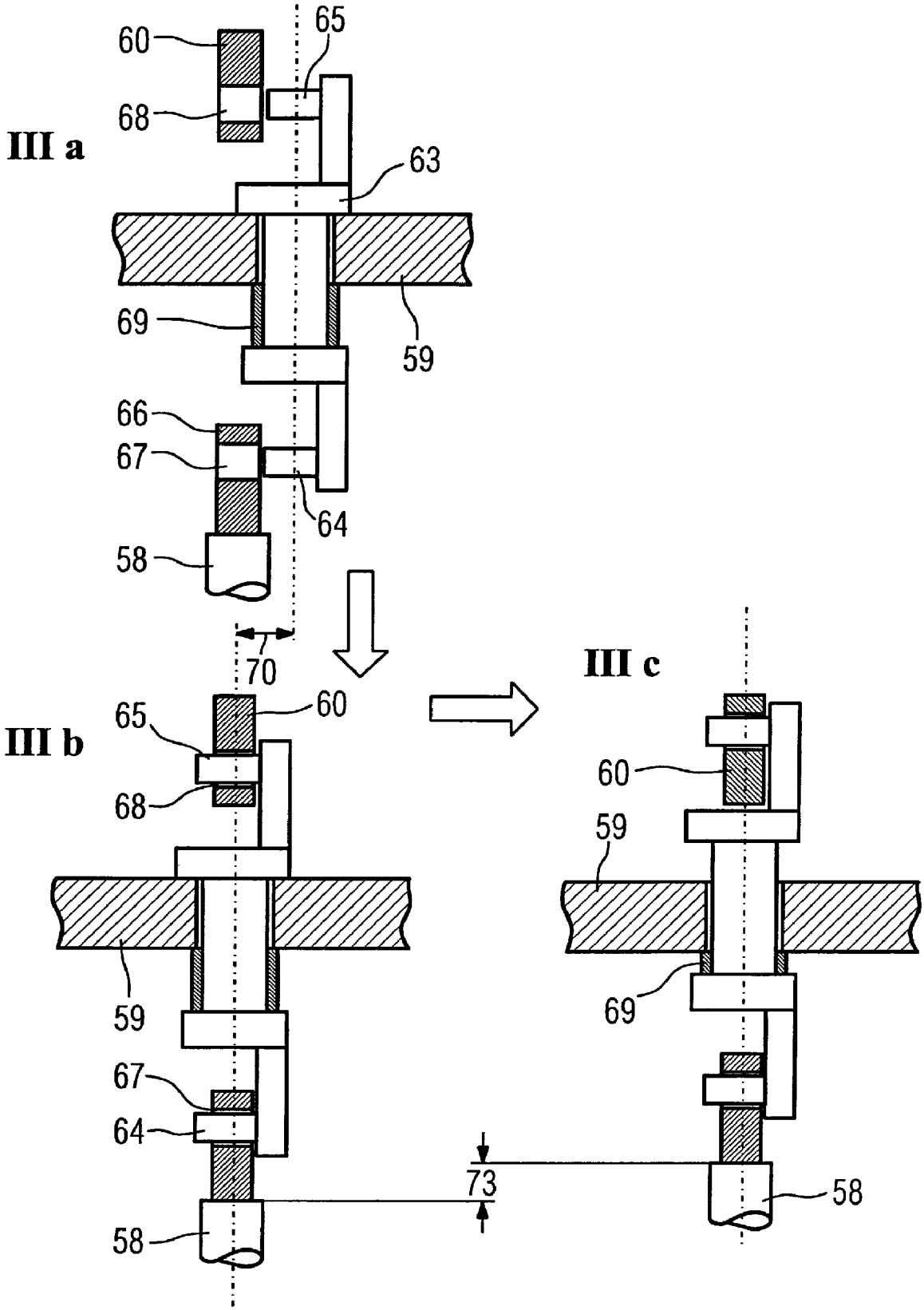
FIG. 25 shows lateral sections through a node of the relay arrangement for explanation of the coupling function.
Figure 26:
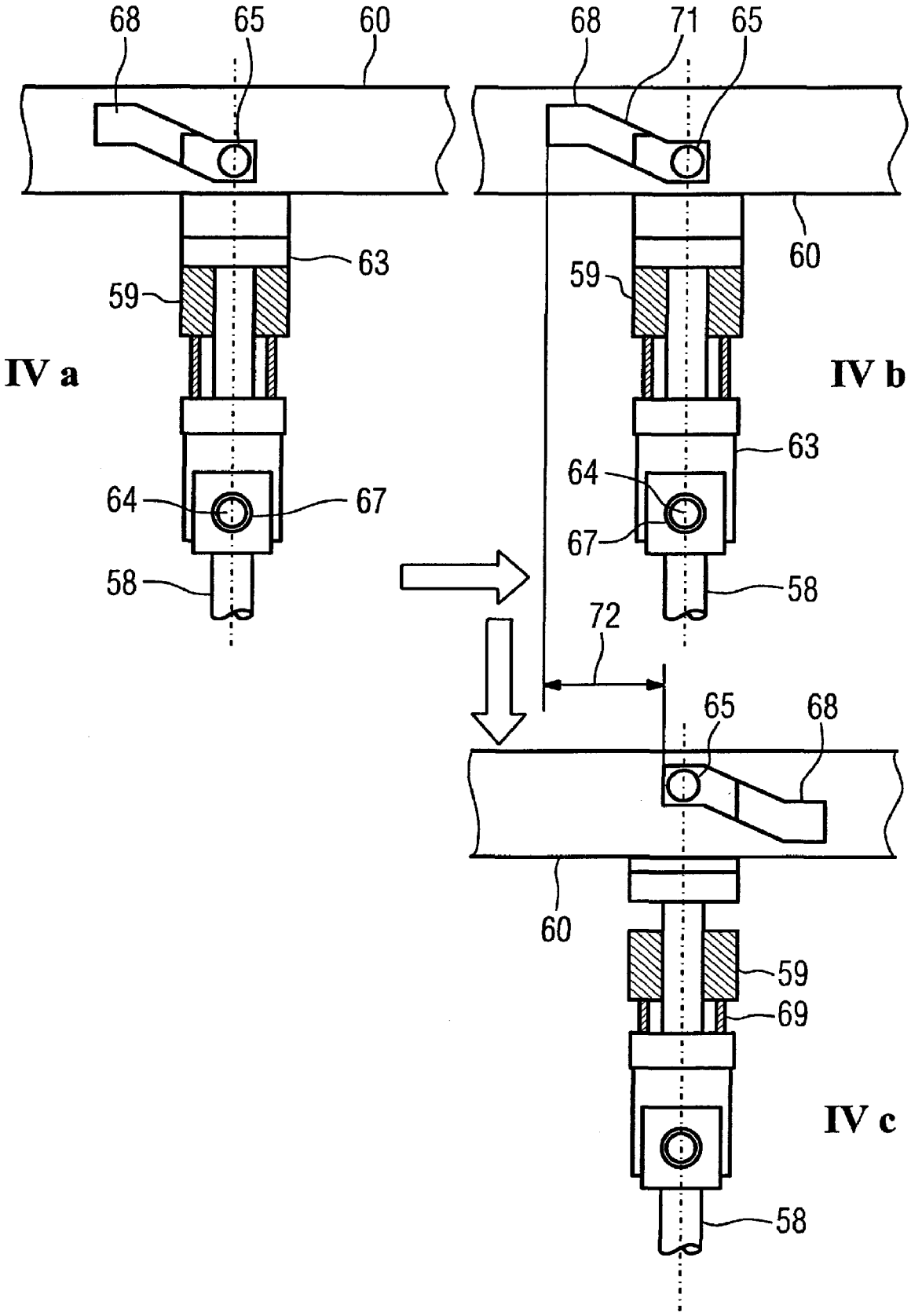
FIG. 26 shows lateral sections through a node of the relay arrangement for explanation of the coupling function.

The functionality of the coupling devices 63 in cooperation with the switching rails and the detailed design of the coupling devices are explained in detail via FIGS. 25 and 26, which ideally are to be considered simultaneously. Two lateral views that are designated with III and IV in FIG. 24 are thereby respectively presented in various phases. FIG. 25 thereby shows the view 111, FIG. 26 the view IV at various points in time of the actuation process.

As shown in FIGS. 25 and 26, the coupling devices 63 comprise a first actuating pin 64 and a second actuating pin 65. Corresponding to the position of the actuating pin 64, an opening 67 that is fashioned for accommodation of the actuating pin 64 with positive fit is provided in an extension 66 of the switching rod 58 of the relay 53. A profile opening 68 that can accommodate the second actuating pin 65 is provided in the second switching rail 60.

The coupling device 63 also has a resilient element 69 for compensation of the movement of the coupling device 63 for actuation of the relay 53 counter to the first switching rail 59, which is immobile in this direction. The process of the actuation is explained in FIGS. 25 and 26 via the various phases IIIa, IIIb and IIIc as well as the corresponding phases IVa, IVb and IVc. The starting position is shown in IIIa and IVa. Neither the first switching rail 59 nor the second switching rail 60 was actuated. The second switching rail 60 is correspondingly not coupled with the relay 53 or its switching rod 58 via the coupling device 63. In this case an actuation of the second switching rail 60 has no effect. In order to now be able to actuate a relay 60, the first switching rail 59 associated with the corresponding row 55 must first be actuated. For this the first switching rail 59 is initially moved towards the left in FIG. 25, as is indicated by the arrow 70. The first actuating pin 64 and the second actuating pin 65 thereby enter into the opening 67 or, respectively, the profile opening 68. This is shown in the view IIIb in FIG. 25. This change is not yet apparent in FIG. 26, view IVb since the movement has occurred perpendicular to the viewing plane. However, as is clearly to be learned from FIG. 25, view IIIb, the switching rod 58 is now coupled to the second switching rail 60. A direct movement coupling of the coupling device 63 and the switching rod 58 upward or, respectively, downward in FIG. 25 or, respectively, 26 is now provided via the positive-fit accommodation of the first actuating rod 64 in the opening 67. As is also to be learned from FIG. 26, view IVb, the second actuating pin 65 is now located at the lower stop of the profile opening 68 (which exhibits an incline 71).

If an actuation of the second switching rail 60 (corresponding to column 56 of the relay 53) to the right in FIG. 26 now ensues (as is indicated by the arrow 72), the second actuating pin 65 moves up the incline along the profile. The movement of the second switching rail 60 in FIG. 26 towards the right is thereby translated into a movement of the coupling device 63 (and thus of the switching rod 58) upward in FIGS. 25 and 26, as is indicated by the interval 73 in FIG. 25. The state shown in the views IIIc and IVc results. The second actuating pin 65 is now located at the upper stop point of the profile opening 68. Since the first switching rail 59 cannot be moved in this direction due to its being borne in the bearings 61, the elastic element 69 is now corresponding compressed (as is to be learned from the views IIIc and IVc).

In the situation shown in the views IIIc and IVc of FIGS. 25 and 26, the second circuit board is now located at a distance from the first circuit board and was already rotated a bit by means of the guidance profile of the device for automatic rotation. To complete the actuation, the switching station 59, 60 are now again returned into their original position. For this the second switching rail 60 is initially moved to the left in FIG. 26. The switching rod 58 is thereby again pressed downward, the second circuit board approaches the first circuit board and finally is pressed against this while the remaining rotation is carried out in the subsequently contact position. The relay 53, the crossbar switch 54, is now switched [sic]. In order to decouple the relay 53 and the second switching rail 60 again, the first switching rail 59 must now only be returned into its original position again via movement to the right in FIG. 25.

Although in this case a crossbar distribution was described as a relay arrangement, it is possible to realize a plurality of other switching functions in the inventive relay arrangement. The relays 53 can in particular also all represent different switching functions.

The inventive relay and the inventive relay arrangement are in particular also suitable for use in magnetic resonance when the arrangements comprise for the most part non-magnetic materials. Relays are in particular frequently used in radio-frequency engineering in the field of magnetic resonance.

Although modifications and changes may be suggested by those skilled in the art, it is the intention of the inventor to embody within the patent warranted hereon all changes and modifications as reasonably and properly come within the scope of his contribution to the art.

I claim as my invention:

1. A selectively configurable relay comprising:

a spatially fixed first circuit board having a first contact thereon and a first conductor trace thereon connected to said first contact;

a second circuit board having at least two second contacts thereon and at least one second conductor trace thereon connected to said at least two second contacts, said second circuit board being mounted for movement relative to said spatially fixed first circuit board; and a mechanical actuator in mechanical engagement with said second circuit board that moves said second circuit board selectively into any of a plurality of different positions relative to said spatially fixed first circuit board, each of said different positions of said second circuit board producing a different electrical connection state between said first contact and said at least two second contacts.

2. A relay as claimed in claim 1 wherein at least one of said first circuit board and said second circuit board is removably mounted in said relay, allowing that circuit board to be removed and replaced.

3. A relay as claimed in claim 1 wherein at least one of said first and second circuit boards has a configuration of conductors thereon that forms an electrical circuit component.

4. A relay as claimed in claim 1 wherein said first conductor trace is disposed on a first side of said first circuit board and wherein said at least one second conductor trace is disposed on a first side of said second circuit board, and wherein at least one of said first circuit board and said second circuit board comprises a conductive ground plane disposed at a second side of that circuit board, opposite said first side.

5. A relay as claimed in claim 1 wherein said first and second circuit boards are parallel to each other, and wherein said mechanical actuator imparts a movement to said second circuit board selected from the group consisting of spacing said second circuit board from said first circuit board, rotating said second circuit board by a predetermined switching angle associated with a change in contact position, and converging said second circuit board on said first circuit board to make an electrical connection between said first contact and at least one of said second contacts in a contact position.

6. A relay as claimed in claim 5 wherein said mechanical actuator comprises a linear motor selected from the group consisting of electromagnetic linear motors, piezoelectric motors, and pneumatic motors to space and converge said first and second circuit boards relative to each other.

7. A relay as claimed in claim 5 wherein said mechanical actuator comprises a linear motor having unstable rest positions, and a return element that causes said second circuit board to converge on said first circuit board.

8. A relay as claimed in claim 7 comprising a further return element that allows adjustment of a contact force of said second circuit board on said first circuit board.

9. A relay as claimed in claim 5 wherein said mechanical actuator comprises a device that automatically rotates said second circuit board relative to said first circuit board upon said second circuit board being either spaced from or converging on said first circuit board.

10. A relay as claimed in claim 9 wherein said device for automatic rotation comprises a cylinder coupled for co-movement with said second circuit board, and a guide tube in which said cylinder is disposed, with an outer wall of said cylinder facing an inner wall of said guide tube, a guide profile comprising a plurality of catch positions respectively corresponding to different contact positions disposed on one of said inner wall or said outer wall, and at least one guide pin engaging said profile mounted on the other of said outer wall or said inner wall, said guidance profile comprising angled guidance surfaces along which said guide pin is directed upon spacing and converging of said first and second circuit boards, to direct said guide pin to a next-successive one of said catch positions, in which said guide pin engages upon converging of said second circuit board on said first circuit board.

11. A relay as claimed in claim 9 wherein said mechanical actuator comprises a rotation motor that rotates said second circuit board relative to said first circuit board.

12. A relay as claimed in claim 1 wherein said second circuit board is comprised of resilient material.

13. A relay as claimed in claim 1 wherein said mechanical actuator comprises a mounting element to which said second circuit board is mounted, and a resilient bearing element disposed between said mounting element and said second circuit board.

14. A relay as claimed in claim 13 comprising an elastic spacer between said second circuit board and said bearing element, said spacer having a surface and contacting said second circuit board only at a portion of said surface, to form at least one hollow space.

15. A relay as claimed in claim 14 wherein said spacer is positioned so that said hollow space corresponds to a position of at least one of said second contacts on said second circuit board.

16. A relay as claimed in claim 1 wherein at least one of said first contact and said at least two second contacts is formed as a spring contact.

17. A relay as claimed in claim 1 comprised substantially of non-magnetic materials.

18. A relay as claimed in claim 1 wherein said first circuit board has at least two first contact thereon, and wherein said second circuit board has at least two second conductor traces respectively connected to said at least two second contacts thereon, and wherein said mechanical actuator is operable to selectively connect any two of said first contacts with any two of said second contacts.

19. A relay as claimed in claim 18 wherein said mechanical actuator operates said relay as a 1:n multiplexer.

20. A relay as claimed in claim 1 wherein said first circuit board has four first contacts thereon and wherein said second relay has four second contacts thereon respectively connected to two second conductor traces thereon, and wherein said mechanical actuator operates said relay as a two-way switch.

21. A relay as claimed in claim 1 wherein said second circuit board has a second conductor trace respectively connected to each of said at least two second contacts, the respective second conductor traces forming stubs of different lengths, and said mechanical actuator operating said relay to electrically connect said first contact with any of said second contacts.

22. A relay as claimed in claim 1 wherein each of said second contacts on said second circuit board has a second conductor trace connected thereto, the respective second conductor traces having conductive surfaces of different sizes, and said mechanical actuator operating said relay to selectively connect said first contact with any of said second contacts.

23. A relay as claimed in claim 1 wherein said mechanical actuator operates said relay as a crossbar switch.

24. A relay as claimed in claim 1 wherein said second circuit board comprises shielded conductors that extend across said second circuit board in at least one position of said second circuit board relative to said first circuit board.

25. A relay as claimed in claim 1 wherein said second circuit board is mounted for rotational movement relative to said spatially fixed first circuit board, and wherein said mechanical actuator moves said second circuit board selectively into any of said plurality of different positions relative to said spatially fixed first circuit board by rotating said second circuit board through a plurality of predetermined switching angles, each switching angle being respectively associated with a different electrical connection state between said first contact and said at least two second contacts.

* * * * *